US005434480A

United States Patent [19]

Bobel

[11] Patent Number: 5,434,480

[45] Date of Patent: Jul. 18, 1995

[54] ELECTRONIC DEVICE FOR POWERING A GAS DISCHARGE ROAD FROM A LOW FREQUENCY SOURCE

[76] Inventor: Andrzej A. Bobel, 201 Norman Ct., Des Plaines, Ill. 60016

[21] Appl. No.: 134,976

[22] Filed: Oct. 12, 1993

[51] Int. Cl.[6] ..... H05B 37/02

[52] U.S. Cl. ..... 315/224; 315/209 R; 315/287; 315/200 R; 315/DIG. 2

[58] Field of Search ..... 315/287, 224, 219, 209 R, 315/244, 200 R, DIG. 2, DIG. 5, DIG. 7

[56] References Cited

U.S. PATENT DOCUMENTS

| | | | |
|---|---|---|---|
| 4,017,785 | 4/1977 | Perper | 315/209 R X |
| 4,109,307 | 8/1978 | Knoll | 315/224 X |
| 4,642,745 | 2/1987 | Steigerwald et al. | 363/37 |
| 4,782,268 | 11/1988 | Fähnrich et al. | 315/209 R X |
| 4,808,887 | 2/1989 | Fahnrich et al. | 315/224 X |
| 4,954,754 | 9/1990 | Nilsson | 315/219 |
| 4,985,664 | 1/1991 | Nilssen | 315/209 R |
| 5,008,597 | 4/1991 | Zuchtriegel | 315/287 X |
| 5,010,277 | 4/1991 | Courier de Mere | 315/200 R |
| 5,049,790 | 9/1991 | Herfurth et al. | 315/291 |
| 5,099,407 | 3/1992 | Thorne | 315/DIG. 7 X |
| 5,113,337 | 5/1992 | Steigerwald | 363/98 |
| 5,150,013 | 9/1992 | Bobel | 315/209 R |

*Primary Examiner*—Robert J. Pascal
*Assistant Examiner*—Haissa Philogene
*Attorney, Agent, or Firm*—Hill, Steadman & Simpson

[57] ABSTRACT

An electronic device for powering a gas discharge load (FL1) from a low frequency alternating voltage source (AVS). This device is drawing a current proportional to a voltage of the source (AVS) and is constituted by a resonant boosting circuit integrated into a power line voltage rectifier (BI,BRB) which performs boost switching and rectifying functions developed by and synchronized with a pulsating current drawn from the rectifier by a resonant oscillator circuit (RO1) equipped with a switching transistors (Q1,Q2) and adapted to energize the gas discharge load (FL1).

10 Claims, 6 Drawing Sheets

ELECTRONIC DEVICE FOR POWERING A GAS DISCHARGE ROAD FROM A LOW FREQUENCY SOURCE

BACKGROUND OF THE INVENTION

1.Field of the Invention

The present invention relates to single stage electronic energy converter operated from an alternating power line, and capable of supplying, at the output, a load such as gas discharge lamp.

2. Description of Prior Art

The electronic energy converters, or as sometimes called "switching power supplies" need to operate directly from the alternating power line. Electric utility companies are setting requirements for specific groups of electricity-powered appliances in regards to power quality drawn by these appliances.

The electronic ballast, as one of the appliances, is used in large quantities in lighting fixtures. In general, to meet the industry requirements in regards to power quality, an electronic ballast has to meet two fundamental requirements: (i) draw power from the power line with a power factor (PF) of at least 0.9, (ii) draw current from the power line with a total harmonic distortion (THD) of less than 20 percent.

The electronic ballast has to meet other requirements related to compatability with a lamp-load. The electronic ballast shall provide lamp current crest factor of less than 1.7, where the "crest factor" is equal to a peak magnitude of the lamp current divided by its effective (RMS) value. This can be, in many situations, related to maximum allowable modulation of the lamp current magnitude, which is responsible for light flicker. It is desirable to have a constant power delivered to the lamp-load over the entire cycle of the voltage supplied by the power line.

In order to convert the low frequency alternating voltage of a conventional power line (120 Volts/60 Hz or 220 Volts/50 Hz) to a high frequency (typically from 10 to 100 kHz) alternating voltage or current source, one has to rectify the signal from the power line, to a DC voltage which later is converted, by switching transistors, to the high frequency source.

Conventional off-line rectifiers have a capacitive smoothing filter located beyond a diode rectifier circuit. This smoothing capacitor causes harmonic distortion of the current waveform during periods in which the rectified output is higher than the voltage over the smoothing capacitor, and during which time the capacitor charges up. This charging time, or conduction angle, is very small if large capacitor is used, and all the required charge has to be loaded into the capacitor in a short period of time. This results in a large current output from the rectified supply during the short conduction angle, and causes the current spikes in the rectified supply. These current spikes increase the harmonic content of the power supply, and when a number of ballasts are being used, this increased harmonic distortion causes a poor power factor in the supply. This situation is not accepted upon by electricity supply authorities, and it causes interference with other electrical equipment.

Techniques for improving power factor include passive waveform shaping methods. One of them is described in U.S. Pat. No. 5,150,013 issued to Bobel. This method requires an inductor to operate in a resonant mode with a capacitor, and the resonant frequency is approximately 180 Hz when power line frequency is 60 Hz. This method is very inexpensive and reliable. However, the inductor must be large in size.

It is also known to use a storage conversion principle, whereby an inductor is controlled at high frequency in order to allow charging of the smoothing capacitor over a wide conduction angle. The system however requires a control circuit for the storage converter, known also as "boost converter", in order to regulate the discharge of energy from the storage inductor. Such a use of the storage conversion principle requires additional noise filtering because of large amount of noise is being generated by switching devices. The circuit is very complex and expensive to produce. Furthermore, the second stage converter is necessary to convert the DC voltage source to the high frequency alternating voltage or current source. This type of circuit is described in U.S. Pat. No. 5,049,790 issued to Herfurth. It is also known to use a single stage converter which draws near sinusoidal current from the sinusoidal power line source, and delivers high frequency current to the lamp-load. In this principle, which uses resonant oscillatory circuit having ability to store and release energy, portion of the resonant energy is re-directed from the output to the input of the converter. This method creates large circulating currents within the oscillatory circuits, thus causes large amount of power being dissipated within the converter. The following patents describe single stage inverters which have portion of the energy from the output redirected to the input of the converter, and exibit large amount of power dissapation.:

| U.S. Pat. No. | Patentee |
|---|---|
| 4,017,785 | Perper |
| 4,109,307 | Knoll |
| 4,642,745 | Steigerwald et al. |
| 4,782,268 | Fahnrich et al. |
| 4,808,887 | Fahnrich et al. |
| 4,985,664 | Nilssen |
| 4,954,754 | Nilssen |
| 5,010,277 | Courier de Mere |
| 5,134,556 | Courier de Mere |
| 5,113,337 | Steigerwald |
| 5,099,407 | Thorne |
| 5,103,139 | Nilssen |

It is highly desirable to have a simple and low cost single stage electronic ballast to solve problems of the above inventions and meet all the industry requirements.

However, this applicant is not aware of any prior art relevant to an integrated, single stage electronic energy converter wherein, the energy used to correct the power factor is not re-directed from the output to the input of the device.

SUMMARY OF THE INVENTION

An object of the invention is to provide a relatively simple, cost effective, highly reliable and highly efficient electronic ballast for a variety of gas discharge loads and power level requirements.

Another object is that of providing integrated into a single stage and operated with high power factor from the power line, an electronic energy converter having a resonant boosting circuit naturally and automatically synchronized with a load connecting and energizing resonant circuit.

Another object of the invention is that of providing an integrated into a single stage electronic energy converter wherein, the energy used to correct the power factor is not re-directed from the output to the input of the device, and is rather stored within and released by the resonant boosting circuit integrated with the voltage rectifier circuit, at the input of the converter.

In accordance with the present invention, there is provided an electronic device adapted for powering a gas discharge load from a low frequency alternating voltage source, the device having DC terminals and comprising:

a rectifier circuit having unidirectional devices connected to form AC input terminals and a pair of output terminals which form positive and negative DC terminals, respectively, and the rectifier circuit having each of the unidirectional devices exhibiting a switching action characterized by an ON-time period when conducting electrical current, and characterized by OFF-time period when not conducting electrical current;

a resonant boosting circuit operable to provide between the DC terminals a variable DC voltage having an absolute peak magnitude higher then absolute peak magnitude of a rectified voltage of the alternating voltage source, and the resonant boosting circuit comprising: (i) boosting inductance connected in circuit between the AC input terminals and the alternating voltage source, and (ii) bosting capacitance connected in parallel with the unidirectional devices of the rectifier circuit;

a energy-storage capacitor having input terminals and connected with a diode in a series circuit which is connected between the DC terminals, the diode having its anode electrode connected to the positive DC terminal, and the diode being operative, in conjunction with the energy-storage capacitor, to develop between the input terminals a DC input voltage separated from the variable DC voltage, and the energy-storage capacitor being operative to receive the energy from the resonant boosting circuit during the OFF-time period and whenever an instantaneous magnitude of the variable DC voltage is higher than an instantaneous magnitude of the DC input voltage;

a switching transistor inverter connected to the energy-storage capacitor and having two alternately conducting transistors connected to form a common junction therebetween; and a resonant oscillator circuit coupled to the DC terminals and to the common junction of the switching transistor inverter, being operable to draw from the DC terminals a pulsating current conducted by the unidirectional devices, and comprising: (i) an inductive element and a capacitive element being adapted to have the gas discharge load driven thereby, and (ii) an oscillation control circuit operable to deliver to the alternately conducting transistors a oscillation control signal to cause the resonant oscillator circuit to oscillate with a frequency which is maintained in proportion to a modulated amplitude of the variable DC voltage;

wherein, the pulsating current, when drawn from the DC terminals, is causing the unidirectional devices to exibit the switching action, thus causing the resonant boosting circuit to store and release energy during ON-time and OFF-time periods being proportional to a time period of a half-cycle associated with the frequency of oscillation of the resonant oscillator circuit; the boosting inductance and the boosting capacitance are operable to resonantly interact, and have a resonant frequency near or equal to the frequency of oscillation of the resonant oscillator circuit, and the resonant interaction is naturally and automatically synchronized with the oscillation of the resonant oscillator circuit; each of the alternately conducting transistors having a duty cycle associated with the conduction and the duty cycle is automatically modulated in proportion to the instantaneous amplitude of the variable DC voltage; the frequency of oscillation of the resonant oscillator circuit is considerable faster than a half-cycle frequency of the alternating voltage source; whereby, an instantaneous magnitude of a current drawn from the alternating voltage source is substantially proportional to an instantaneous magnitude of the voltage of the alternating voltage source.

A further feature of the invention is provided in which the resonant oscillator comprising: (i) an inductor and a capacitor connected in series and being adapted to power the gas discharge load effectively connected in parallel with the capacitor, and (ii) a switching feedback transformer being responsive to an instantaneous magnitude of the pulsating current and operable to deliver to the alternately conducting transistors a switching signal proportional to the instantaneous magnitude of the pulsating current, and to cause the resonant oscillator circuit to oscillate with a frequency which is automatically maintained to be directly proportional to a modulated amplitude of the variable DC voltage.

A further feature of the invention is provided in which the resonant oscillator circuit being operable to draw from the DC terminals a pulsating current conducted by the unidirectional devices, and to develop a pulsating voltage at its output terminals, and the resonant oscillator circuit comprising: (i) an inductor, a capacitor, and the gas discharge load, all being effectively connected in a parallel circuit adapted to power the gas discharge load, and the parallel circuit being connected between the output terminals, and (ii) a switching feedback windings magnetically coupled to the resonant inductor and operable to deliver to the alternately conducting transistors a switching signal proportional to the instantaneous magnitude of the pulsating voltage, and operable to cause the resonant oscillator circuit to oscillate with a frequency which is automatically maintained directly proportional to a modulated amplitude of the variable DC voltage.

In accordance with the present invention, the boosting inductance can be either: ( i ) in the form of a simple inductor, (ii) in the form of a sectored common mode or a differential inductor, or (iii) in the form of two independent inductors.

In accordance with the present invention the rectifier circuit can be either in the form of a full-wave rectifier bridge circuit or a doubler circuit.

In accordance with the present invention, the boosting capacitance comprising one or more capacitors is connected in parallel with selected one or more unidirectional devices of the rectifier means.

In accordance with the present invention, the resonant oscillator circuit having one or more of the gas discharge lamps effectively connected in parallel with the capacitor, either in non-isolated or isolated configuration, wherein an isolation transformer and the inductor can be integrated into one magnetic structure.

Further features of the present invention will become apparent from the description below of preferred embodiments of the invention, made by way of example only, and with reference to the accompanying drawings.

DESCRIPTION OF THE PREFERRED EMBODIMENT

Figure 1:
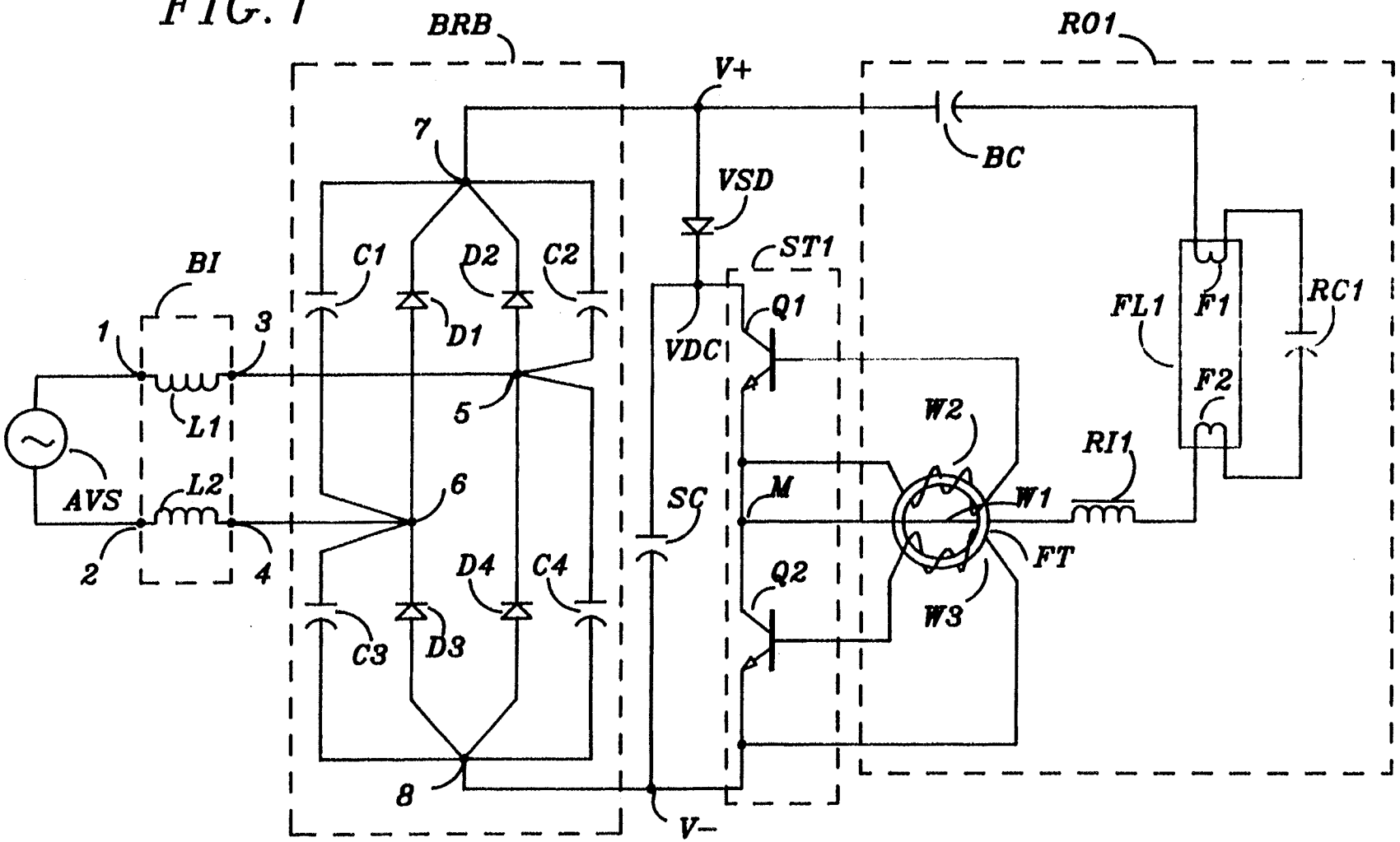
FIG.1 schematically illustrates the invention in its first embodiment.

In FIG.1 rectifier diodes D1,D2,D3,D4 are connected in the form of a full-wave rectifier bridge having two AC input terminals 5,6 and two DC output terminals 7,8. The terminal 7 is the positive one (V+) and the terminal 8 is the negative one (V−).

A boosting and rectifying bridge BRB includes the diodes D1,D2,D3,D4 and has capacitors C1,C2,C3,C4 connected across each diode, respectively. The capacitors are equal in value which is approximately 10 nF.

A four-terminal boosting inductor BI has power input terminals 1,2 and output terminals 3,4. An inductor L1 is connected between terminals 1 and 3. Further, an inductor L2 is connected between terminals 2 and 4. The terminal 3 is connected to the terminal 5, and the terminal 4 is connected to terminal 6.

An alternating voltage source AVS is connected to the terminals 1 and 2.

A voltage separating diode VSD is connected with its anode electrode to the terminal V+.

A storage capacitor SC (having a value of approximately 33 uF) is connected at its positive terminal the cathode electrode of the diode VSD, forming an intermediate node VDC. The negative terminal of the capacitor SC is connected directly with the terminal V−.

A half-bridge switching transistor inverter STI has a bipolar transistor Q1 (of the type MJE 13005) connected at its collector electrode to the intermediate node VDC. The transistor Q1 has its emitter electrode connected to a node M. A further npn transistor Q2 (like the transistor Q1, of the type MJE 13005) of the inverter STI has its collector electrode connected to the node M. The transistor Q2 has its emitter electrode connected to the terminal V−.

A resonant oscillator RO1 has a DC blocking capacitor BC (having a value of approximately 0.1 uF), and a resonant capacitor RC1 (having a value of approximately 18 nF), and a resonant inductor RI1 (having a value of approximately 1 mH), and a primary winding W1 of a feedback transformer FT, all connected in series between terminal V+ and the node M, via filaments F1 and F2 of a gas discharge lamp FL1. Thereby, the gas discharge lamp (of the type Dulux E 26W by Osram) is effectively connected across the resonant capacitor RC1. The feedback transformer is equipped with two secondary windings W2, W3 connected across base-emitter junctions of the transistors Q1 and Q2, respectively.

Figure 2:
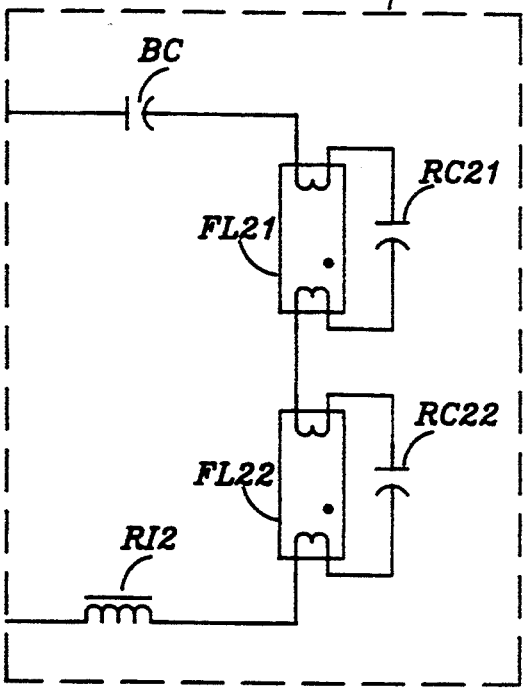
FIG. 2, FIG. 3, FIG. 4(*a*) and FIG. 4(*b*) show fragmentary illustrations of the alternative versions of the embodiments of FIG. 1, FIG. 5, and FIG. 7.

FIG. 2 illustrates a fragment of a resonant oscillator RO2 as an alternative version of the resonant oscillator RO1. Two gas discharge lamps FL21, FL22 are connectd in series. The lamps FL21, FL22 have resonant capacitors RC21, RC22 connected in parallel, respectively.

Figure 3:
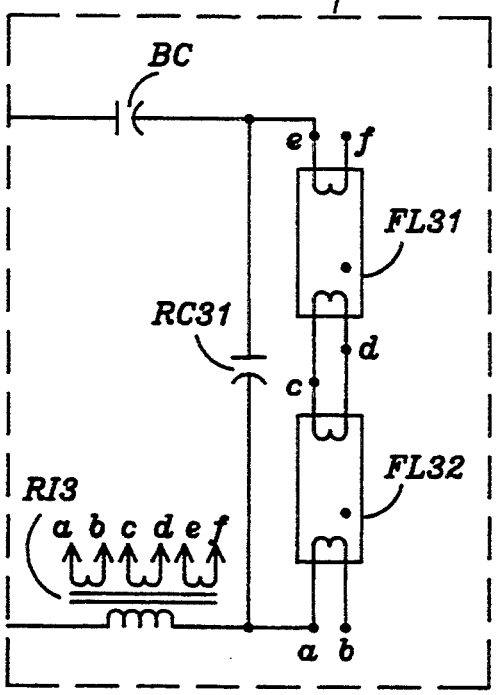

FIG. 3 illustrates a fragment of a resonant oscillator RO3 as another alternative version of the resonant oscillator RO1. Two gas discharge lamps FL31, FL32 are connected in series and have one resonant capacitor RC31 connected thereby. The filaments of the gas discharge lamps are powered by secondary windings of a resonant inductor RI3.

Figure 4A:
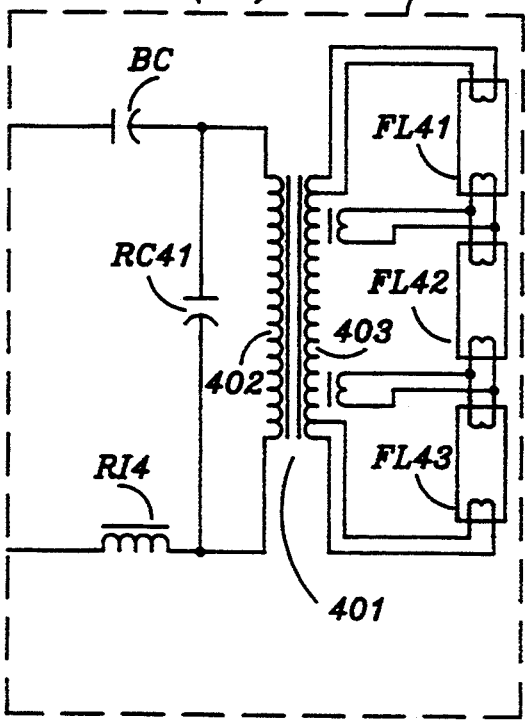
Figure 4B:
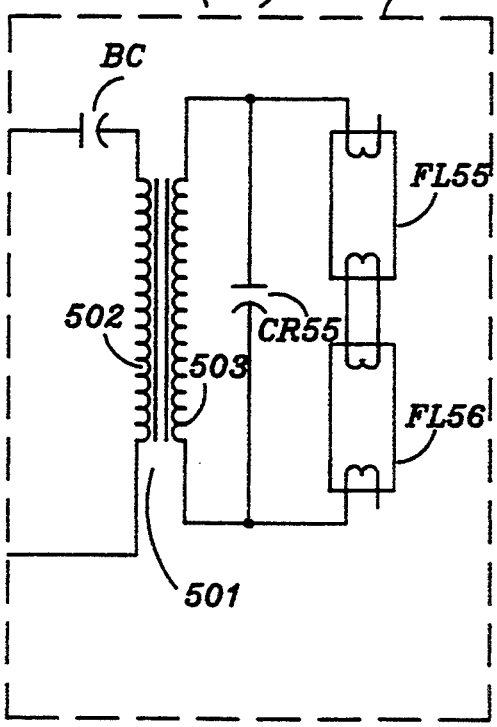

FIG.4(*a*) illustrates a fragment of a resonant oscillator RO4 as another alternative version of the resonant oscillator RO1. An isolation transformer 401 is connected at its primary winding 402 across a resonant capacitor RC41. The secondary winding 403 of the transformer 401 is used to power three fluorescent lamps FL41, FL42, FL43 connected in series.

FIG.4(*b*) illustrates a fragment of resonant oscillator RO44 as yet another alternative version of the resonant oscillator RO1. An isolation transformer 501 has a primary winding 502 and a secondary winding 503. The transformer is constructed in such a way that a leakage inductance exists in a magnetic coupling between the windings, and the leakage inductance serves a function of a resonant inductance, forming a resonant circuit with a capacitor CR55 and gas discharge lamps FL55, FL56.

Figure 5:
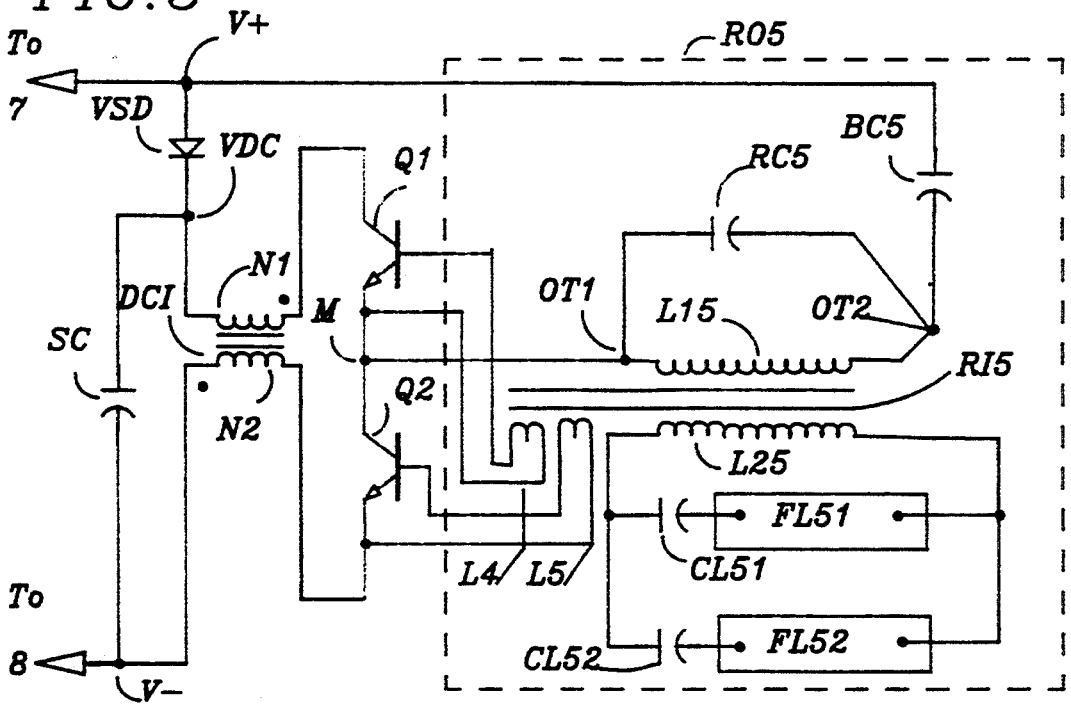
FIG.5 schematically illustrates the invention in its second embodiment.

In FIG. 5 the transistor Q1 is connected at its collector electrode to the intermediate terminal VDC, via winding N1 of a DC inductor DCI. Further, the transistor Q2 is connected at its emitter electrode to the terminal V−, via winding N2 of the DC inductor DCI. A resonant oscillator RO5 has a resonant capacitor RC5 connected in parallel with a primary winding L15 of a resonant inductor RI5, forming a pair of output terminals OT1, OT2. A DC blocking capacitor BC5 is connected between terminal V+ and terminal OT2. The terminal OT2 is connected to the node M. Two gas discharge lamps FL51, FL52 are coupled to the output terminals, via a secondary winding L25 of the inductor RI5. Additional secondary windings L4,L5 of the resonant inductor RI5 are connected between base-emitter junctions of the transistors Q1 and Q2, respectively.

Figure 6:
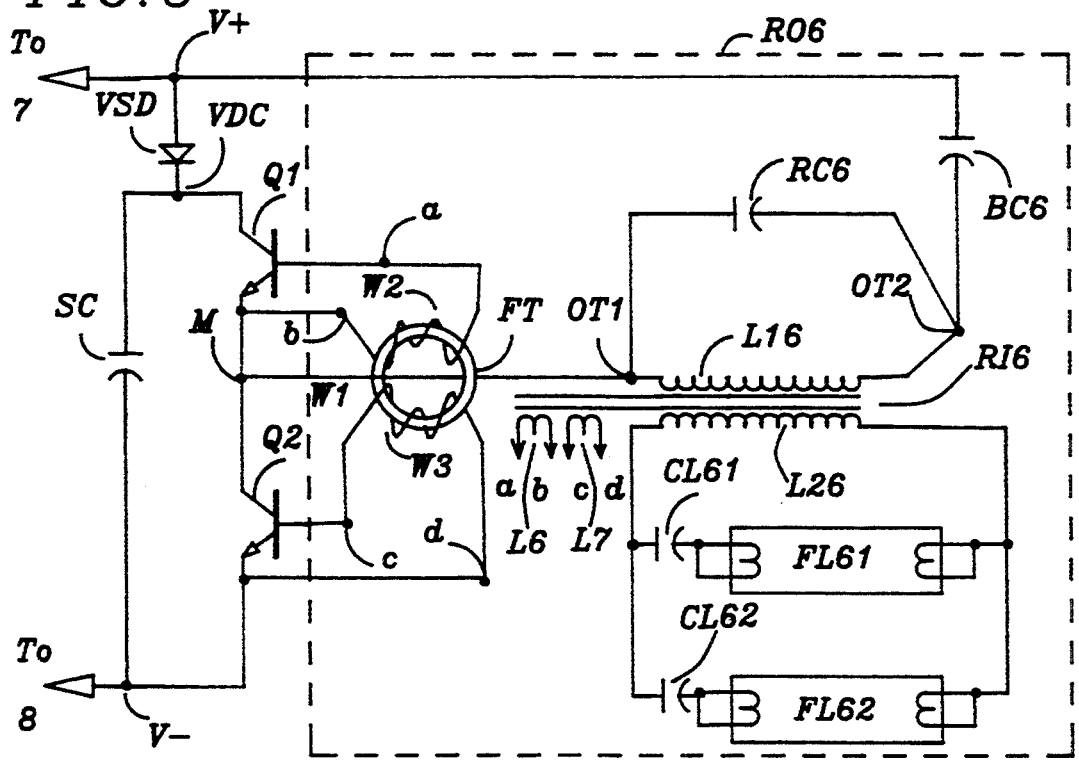
FIG.6 shows an alternative version of the embodiments of FIG.1 and FIG.5.

In FIG.6 which is an alternative version of the circuits of FIG.1 and FIG.5, a resonant capacitor RC6 is connected in parallel with a primary winding L16 of a resonant inductor RI6, forming a pair of output terminals OT1, OT2. A DC blocking capacitor BC6 is connected between terminal V+ and terminal OT2. The terminal OT1 is connected with the node M, via primary winding W1 of the feedback transfomer FT. The secondary windings W2,W3 of the feedback transformer FT are connected between base-emitter junctions of the transistors Q1 and Q2, respectively. Further, secondary windings L6, L7 of the resonant inductor RI6 are also connected between base-emitter junctions of the transistors Q1 and Q2, respectively.

Figure 7:
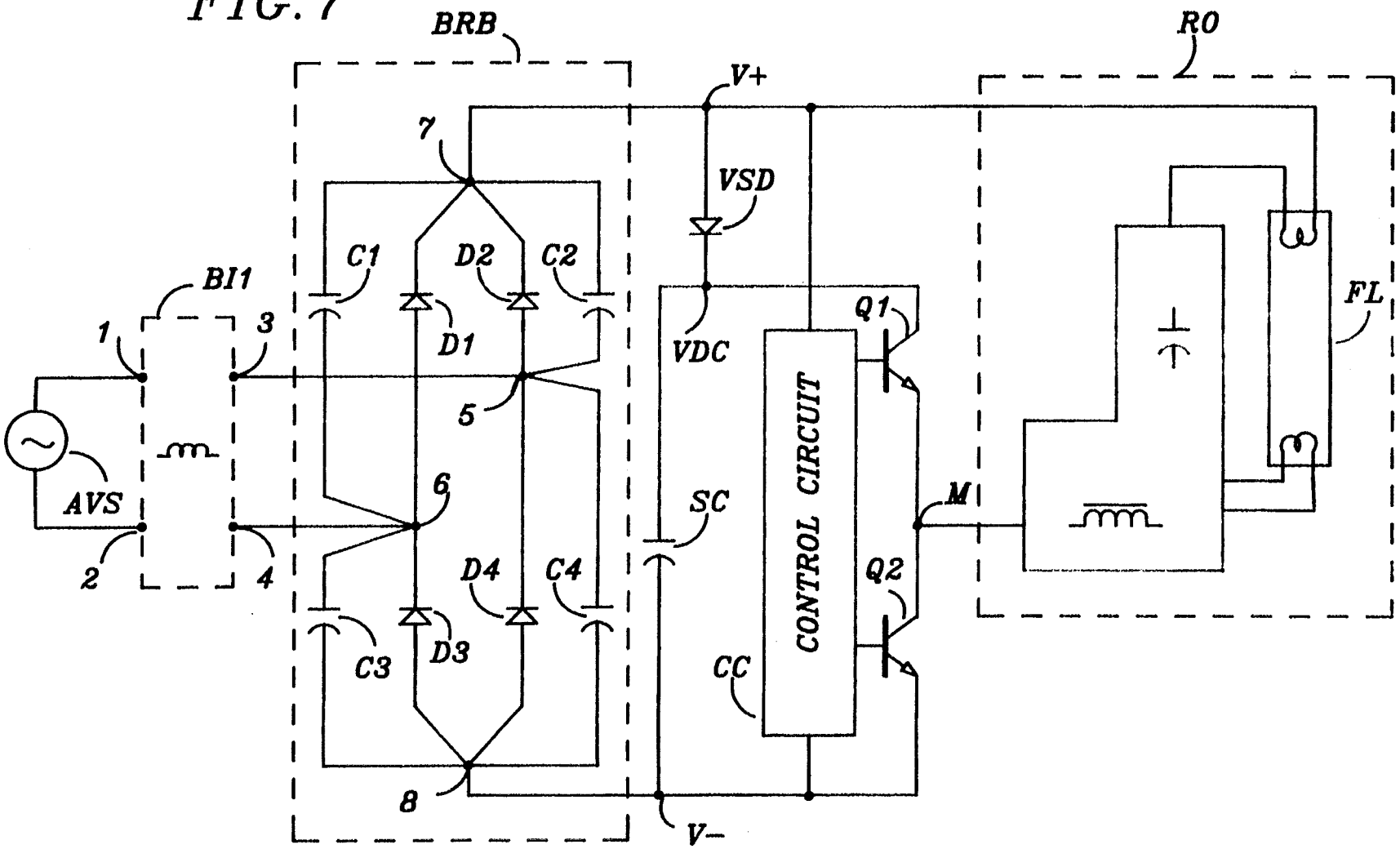
FIG.7 schematically illustrates the invention in its third embodiment.

In FIG.7 a control circuit CC is used to provide a switching signal to the bases of the transistors Q1 and Q2. The control circuit is also connected to the terminals V+ and V−.

Figure 8:
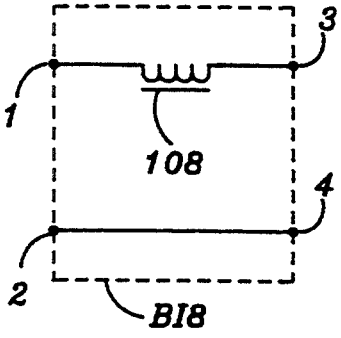
FIG.8, FIG.9, FIG. 10, and FIG.12 show fragmentary illustrations of the alternative versions of the embodiments of FIG. 1, FIG.5 and FIG.7.
Figure 9:
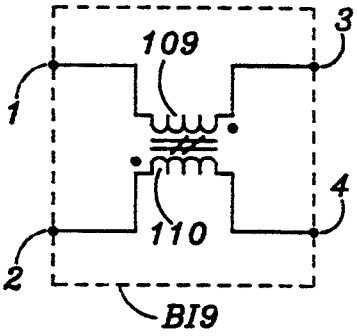
Figure 10:
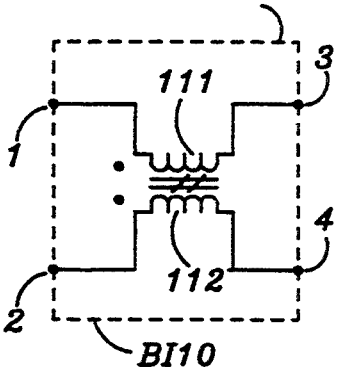

Referring now to FIG.8, FIG.9 and FIG. 10 which are illustrating alternative versions of the boosting inductor BI1. A boosting inductor BIB is a simple inductor connected between terminals 1 and 3. A boosting inductor BI9 is a differential type inductor having two windings 109 and 110. A boosting inductor BI10 is common mode type inductor having two windings 111 and 112.

Figure 11:
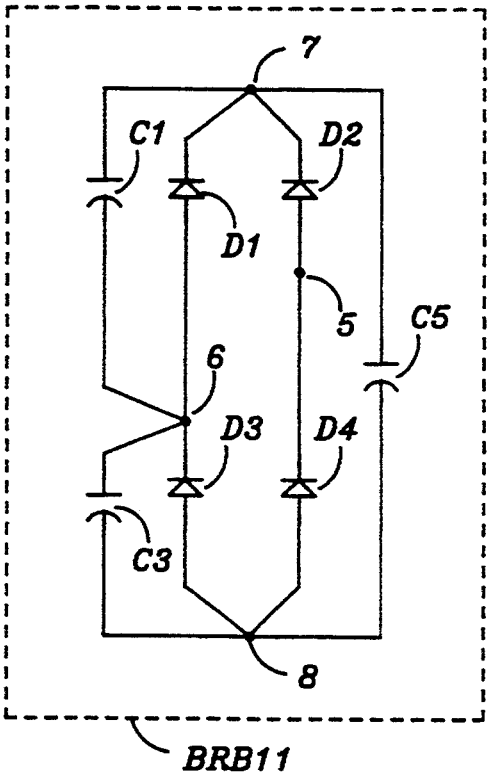

In FIG.11 a boosting and rectifying bridge BRB11 is a alternative version of the boosting and rectifying bridge BRB1 of FIG.1. The capacitors C2 and C4 of FIG.1 are now replaced by a capacitor C5 connected between terminals 7 and 8.

Figure 12:
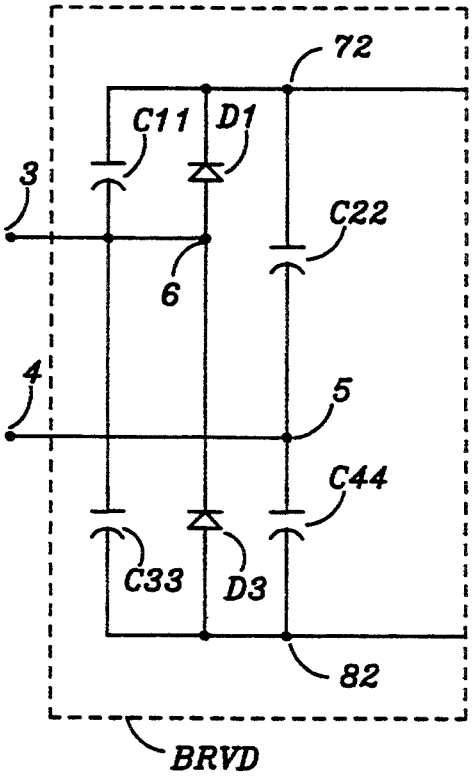

A boosting and rectifying voltage doubler BRVD of FIG. 12, may be substituted for the boosting and rectifying bridge BRB1 of FIG.1. The diodes D2 and D4 of FIG.1 are omitted in this version which is another alternative of the emodiments of the present invention.

In FIG. 1, the alternating voltage source AVS represents an ordinary electric utility power line (120 Volts/60 Hz) which is connected through the inductor BI with the rectifier bridge of the boosting and rectifying bridge BRB. When the rectified voltage is present between terminals V+ and V−, the energy-storage capacitor SC is charged instantly, and high charging current will be flowing through diodes of the rectifier bridge. The boosting inductor BI, in conjunction with the boosting capacitors, forming a high frequency noise filter which is necessary for reduction of noise level, as required by the government regulations.

The device starts its oscillations by triggering provided with a commonly known diac circuit (not shown) or can be initiated simply by momentarily connecting of a capacitor between the V+ terminal and the base of transistor Q2. For better understanding of the operation of the device, let assume that the alternating voltage, as per FIG. 13 (*a*), is at the beginning of the positive half-cycle when the transistor Q2 is switched into its conduction state. When the transistor Q2 is in the conduction state, the resonant oscillator RO1 is effectively connected between terminals V+ and V−. The resonant oscillator RO1 draws a pulsating current from these terminals, and the current is also circulated through the diodes of the boosting and rectifying bridge BRB. Diodes D2 and D3 of the bridge BRB are conducting current to supply energy to the energy-storage capacitor SC, and to the resonant oscillator RO1, and to the lamp load FL1, and to charge the boosting inductor and boosting capacitors connected across diodes D1 and D4. Diodes D1 and D4 of the bridge BRB are not conducting continous current supplied by the power line when the voltage of that line is positive. Therefore, the capacitors connected across diodes D1,D4 are charged up to that voltage magnitude which is present at that time. The pulsating current ends its pulse after a predetermined time period associated with the frequency of the resonant oscillator RO1. Then, the transistor Q1 is switched into its conduction state, and transistor Q2 is switched into its open state. The energy stored in the boosting inductor and boosting capacitors is naturally released and provided as auxiliary voltage, having an instantaneous magnitude higher than the rectified voltage provided by power line at the time. As a result, a variable DC voltage is developed between terminals V+, V−, as per FIG.13(*b*). The energy-storage capacitor SC is instantly charged-up to a voltage magnitude which is a result of a natural integration. The frequency of oscillation of the resonant oscillator is approximately 35 kHz. Therefore, during the positive half-cycle of the voltage supplied by the power line, the diodes D2 an D3 will be conducting pulsed current 291 times.

Figure 13A:
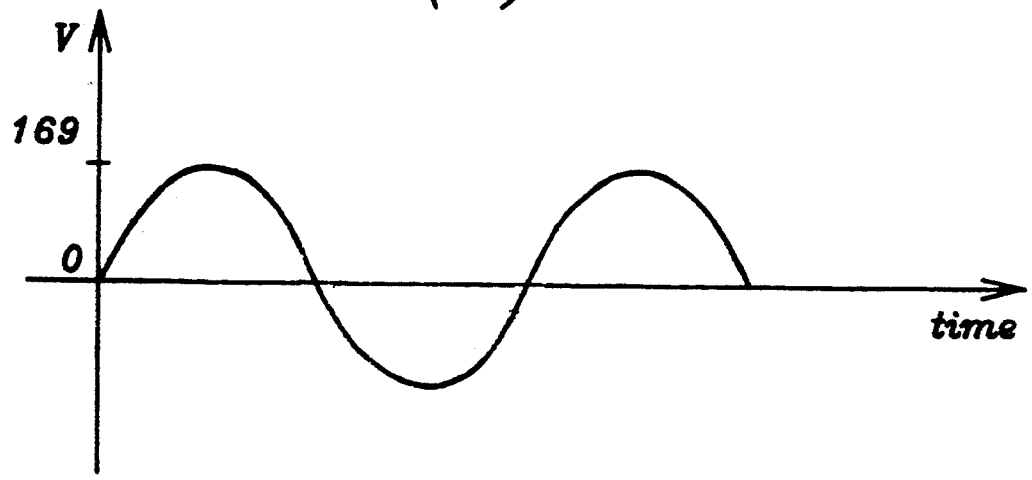
FIG. 13 (*a, b, c*), shows various waveforms associated with operation of the device of the present invention.
Figure 13B:
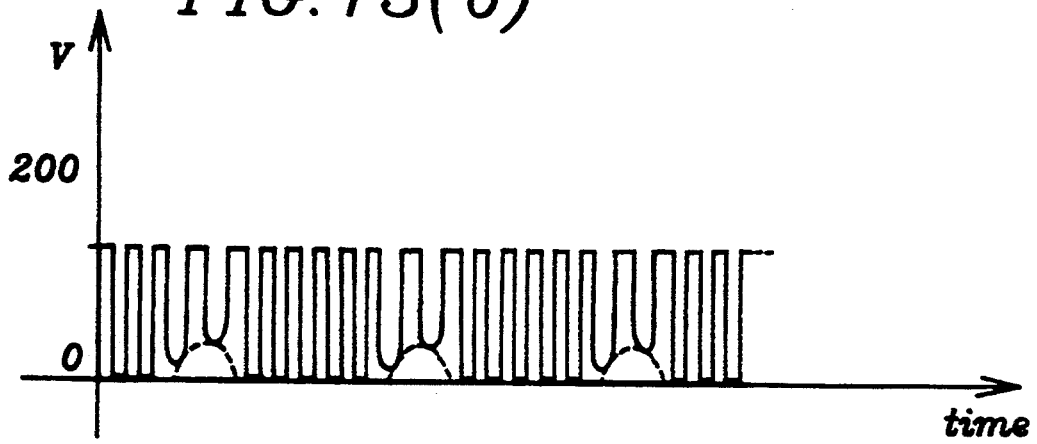
Figure 13C:
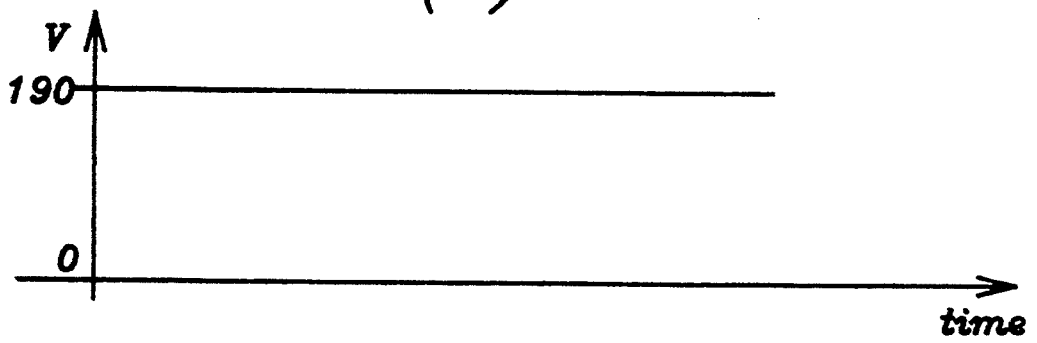

When the power line voltage is near its peak, the auxiliary voltage, when added to the power line voltage, would normally cause a very high instantaneuos voltage between terminals V+ and V− to be present, if not for a switching feedback arrangement instant response. The resonant oscillator having the feedback transformer responsive to the instantaneous magnitude of the pulsating current, adjusts its frequency in such a way, that the auxiliary voltage is instantly adjusted to effect the amplitude of the variable DC voltage to be instantly lowered, as shown in FIG.13(*b*). The transistors' duty cycle is also instantly adjusted. The complete circuit is naturally and automatically synchronized and self-controlled. The resonant frequency associated with the resonant oscillator is also chosen to satisfy a fundamental reliability rule of this type of device: impedance of the resonant circuit shall be always inductive, despite of variations of the load magnitude or power line voltage magnitude. In order to produce a high power factor and a low THD, the boosting capacitance and boosting inductance are tuned to relatively the same frequency as is the oscillation frequency of the resonant oscillator RO1.

The voltage separating diode VSD permits charging of the energy-storage capacitor SC, whenever the variable DC voltage rises above voltage present at the time across the capacitor SC. Thereby, a constant DC voltage is developed across terminals of the capacitor SC, as shown in FIG. 13(*c*). The alternately conducting transistors Q1, Q2 are operated by the feedback transformer FT to connect the resonant oscillator circuit RO1 alternately to the variable DC voltage developed between terminals V+, V−, and to a voltage equal to a sum of instantaneous magnitudes of the constant DC voltage and the variable DC voltage. Thus, the constant DC voltage serves as an effective energy reserve, activated when is needed to provide a relatively constant power to the lamp-load, over the cycle of the alternating voltage provided by the source AVS.

Naturally, the energy-storage capacitor SC is being partially charged from the power line and partially from the energy storing boosting capacitors and boosting inductor BI. In result, the waveform of the current drawn from the power line become proportional to the voltage waveform of that line. Then, the power factor of the entire device is near 0.99 and total harmonic distortion of the current drawn from the power line is less than 10 percent.

At the time, when the power line voltage is at its negative half cycle, the diodes D1 and D4 are conducting the continous line current, and the diodes D2 and D3 are conducting the pulsating current. The diodes D2, D3 perform a boost switching function, when the diodes D1, D4 perform a boost rectifying function. The two pairs of diodes reverse their functions, when the power line voltage reverses from positive to negative and vice-versa. Also, the boosting capacitors C2 and C3 along with the boosting inductor BI provide the auxiliary voltage across terminals V+ and V−. All other functions of the device components are the same as in the positive half-cycle of the power line voltage.

FIG.5, attached hereto, represents the device in its second embodiment. The circuit shown here is identical in operation to the one of FIG. 1, with the exception that the resonant elements are connected here in parallel. The switching feedback is accomplished with use of secondary windings L4, L5 operable to provide switching signal proportional to the pulsating voltage which is developed across both resonant elements.

Device of FIG.6 is the alternative version of devices of FIG. 1 and FIG. 5, wherein the switching signal provided to the switching transistors Q1, Q2 is a combination of: (i) signal proportional to the resonant voltage and provided by windings L6 and L7, and (ii) signal proportional to the pulsating current provided by the feedback transformer. Otherwise, the circuit of FIG.6 is identical in operation to the circuit of FIG.1.

Referring now to FIG.7, in the circuit of the third embodiment of the device, the switching feedback arrangement is substituted by a switching control circuit CC. The frequency of switching is dynamically controlled in reference to the variable DC voltage amplitude developed between terminals V+ and V−. Otherwise, the device operates identically to the device of FIG. 1.

It will thus be appreciated that the described ballast circuit provides a relatively simple, cost-effective, highly reliable and highly efficient electronic ballast, which can be easily constructed to all varieties of gas discharge lamps and power level requirements.

It will be further appreciated that the described ballast circuit provides an improved single stage inverter having resonant boosting circuit integrated with the voltage rectifier. Additionally, the same resonant boosting circuit is operating as filter to reduce high frequency noise level.

It will be further appreciated that the described ballast circuit provides an improved circuit in which the energy is stored and released by the resonant boosting circuit for the purpose of correcting the power factor and providing for relatively constant power to be delivered to the lamp-load.

It will be further appreciated that the described ballast circuit provides unique and novel arrangement having one resonant oscillating circuit adapted to connect and energize the lamp-load, and the second resonant boosting circuit for the purpose described above, wherein both resonant circuit being naturally and automatically synchronized and arranged to dynamically interact.

It will be further appreciated that the described ballast circuit provides a single stage integrated electronic energy converter, wherein the energy to correct the power factor is not re-directed from the output to the input, and is rather stored within and released by the resonant boosting circuit, at the input of the device.

It will be further appreciated that the device as described herein, operate in a manner that the waveform of the current drawn from the alternating voltage source is proportional to the waveform of the voltage source.

It is believed by this applicant that the present invention and its several advantages and features will be understood from the foregoing description. However, it will be apparent to a person skilled in the art that without departing from the spirit of the invention, changes may be made in its form and in the construction and interrelationships of its component parts, the forms herein presented merely representing presently preferred embodiments.

I claim:

1. An electronic device adapted for powering a gas discharge load from a low frequency alternating voltage source, the device having DC terminals and comprising:

rectifier means having unidirectional devices connected to form AC input terminals and a pair of output terminals which form positive and negative DC terminals, respectively, and the rectifier means having each of the unidirectional devices exibit a switching action characterized by an ON-time period when conducting electrical current, and characterized by an OFF-time period when not conducting electrical current;

resonant boosting means operable to provide between the DC terminals a variable DC voltage having absolute peak magnitude higher than absolute peak magnitude of a rectified voltage of the alternating voltage source, and the resonant boosting means comprising: (i) boosting inductance means connected in circuit between the AC input terminals and the alternating voltage source, and (ii) boosting capacitance means connected in parallel with the unidirectional devices of the rectifier means;

energy-storage means having input terminals and connected with a diode means in a series circuit which is connected between the DC terminals, the diode means having its anode electrode connected to the positive DC terminal, and the diode means being operative, in conjunction with the energy-storage means, to develop between the input terminals a DC input voltage separated from the variable DC voltage, and the energy-storage means being operative to receive the energy from the resonant boosting means during the OFF-time period and whenever an instantaneous magnitude of the variable DC voltage is higher than an instantaneous magnitude of the DC input voltage;

semiconductor switching means connected to the energy-storage means and having two alternately conducting transistors connected to form a common junction therebetween;

resonant oscillator means connected to the positive DC terminal of the variable DC voltage and to the common junction of the semiconductor switching means, the resonant oscillator means being operable to draw from the DC terminals a pulsating current conducted by the unidirectional devices, and the resonant oscillator means comprising: (i) an inductor and a capacitor connected in series and being adapted to power the gas discharge load effectively connected in parallel with said capacitor, and (ii) a switching feedback transformer being responsive to an instantaneous magnitude of the pulsating current and operable to deliver to the semiconductor switching means a switching signal proportional to the instantaneous magnitude of the pulsating current, and to cause the resonant oscillator means to oscillate with a frequency which is automatically maintained to be directly proportional to a modulated amplitude of the variable DC voltage;

wherein, the pulsating current, when drawn from the DC terminals, is causing the unidirectional devices to exibit the switching action, thus causing the resonant boosting means to store and release energy during ON-time and OFF-time periods being proportional to a time period of a half-cycle associated with the frequency of oscillation of the resonant oscillator means; the boosting inductance means and the boosting capacitance means are operable to resonantly interact, and have a resonant frequency near or equal to the frequency of oscillation of the resonant oscillator means, and the resonant interaction is naturally and automatically synchronized with the oscillation of the resonant oscillator means; each of the alternately conducting transistors having a duty cycle associated with the conduction, and said duty cycle is automatically modulated in proportion to the modulated amplitude of the variable DC voltage; the frequency of oscillation of the resonant oscillator means is considerable faster than half-cycle frequency of the alternating voltage source;

whereby, an instantaneous magnitude of a current drawn from the alternating voltage source is substantially proportional to an instantaneous magnitude of the voltage of the alternating voltage source.

2. An electronic device adapted for powering a gas discharge load from a low frequency alternating voltage source, the device having DC terminals and comprising:

rectifier means having unidirectional devices connected to form AC input terminals and a pair of output terminals which form positive and negative DC terminals, respectively, and the rectifier means having each of the unidirectional devices exibit a switching action characterized by an ON-time period when conducting electrical current, and characterized by an OFF-time period when not conducting electrical current;

resonant boosting means operable to provide between the DC terminals a variable DC voltage having absolute peak magnitude higher than absolute peak magnitude of a rectified voltage of the alternating voltage source, and the resonant boosting means comprising: (i) boosting inductance means connected in circuit between the AC input terminals and the alternating voltage source, and (ii) bosting capacitance means connected in parallel with the unidirectional devices of the rectifier means, energy-storage means having input terminals and connected with a diode means in a series circuit which is connected between the DC terminals, the diode means having its anode electrode connected to the positive DC terminal, and the diode means being operative, in conjunction with the energy-storage means, to develop between the input terminals a DC input voltage separated from the variable DC voltage, and the energy-storage means being operative to receive the energy from the resonant boosting means during the OFF-time period and whenever an instantaneous magnitude of the variable DC voltage is higher than an instantaneous magnitude of the DC input voltage;

semiconductor switching means connected to the energy-storage means and having two alternately conducting transistors connected to form a common junction therebetween;

resonant oscillator means connected to the positive DC terminal of the variable DC voltage and to the common junction of the semiconductor switching means, the resonant oscillator means being operable to draw from the DC terminals a pulsating current conducted by the unidirectional devices, and to develop a pulsating voltage at its output terminals, and the resonant oscillator means comprising: (i) an inductor, a capacitor and the gas discharge load being effectively connected in a parallel circuit adapted to power the gas discharge load, and the parallel circuit being connected between the output terminals, and (ii) switching feedback windings magnetically coupled to the resonant inductor and operable to deliver to the semiconductor switching means a switching signal proportional to an instantaneous magnitude of the pulsating voltage, and operable to cause the resonant oscillator means to oscillate with a frequency which is automatically maintained directly proportional to a modulated amplitude of the variable DC voltage, wherein, the pulsating current, when drawn from the DC terminals, is causing the unidirectional devices to exibit the switching action, thus causing the resonant boosting means to store and release energy during ON-time and OFF-time periods being proportional to a time period of a half-cycle associated with the frequency of oscillation of the resonant oscillator means; the boosting inductance means and the boosting capacitance means are operable to resonantly interact, and have a resonant frequency near or equal to the frequency of oscillation of the resonant oscillator means, and the resonant interaction is naturally and automatically synchronized with the oscillation of the resonant oscillator means; each of the alternately conducting transistors having a duty cycle associated with the conduction and said duty cycle is automatically modulated in proportion to the modulated amplitude of the variable DC voltage; the frequency of oscillation of the resonant oscillator means is considerable faster than half-cycle frequency of the alternating voltage source;

whereby, an instantaneous magnitude of a current drawn from the alternating voltage source is substantially proportional to an instantaneous magnitude of the voltage of the alternating voltage source.

3. An electronic device adapted for powering a gas discharge load from a low frequency alternating voltage source, the device having DC terminals and comprising:

rectifier means having unidirectional devices connected to form AC input terminals and a pair of output terminals which form positive and negative DC terminals, respectively, and the rectifier means having each of the unidirectional devices exibit a switching action characterized by an ON-time period when conducting electrical current, and characterized by OFF-time period when not conducting electrical current;

resonant boosting means operable to provide between the DC terminals a variable DC voltage having absolute peak magnitude higher than absolute peak magnitude of a rectified voltage of the alternating voltage source, and the resonant boosting means comprising: (i) boosting inductance means connected in circuit between the AC input terminals and the alternating voltage source, and (ii) boosting capacitance means connected in parallel with the unidirectional devices of the rectifier means, energy-storage means having input terminals and connected with a diode means in a series circuit which is connected between the DC terminals, the diode means having its anode electrode connected to the positive DC terminal, and the diode means being operative, in conjunction with the energy-storage means, to develop between the input terminals a DC input voltage separated from the variable DC voltage, and the energy-storage means being operative to receive the energy from the resonant boosting means during the OFF-time period and whenever an instantaneous magnitude of the variable DC voltage is higher than an instantaneous magnitude of the DC input voltage;

semiconductor switching means connected to the energy-storage means and having two alternately conducting transistors connected to form a common junction therebetween;

resonant oscillator means coupled to the DC terminals and to the common junction of the semiconductor switching means, being operable to draw from the DC terminals a pulsating current conducted by the unidirectional devices, and comprising: (i) an inductive element and a capacitive element being adapted to have the gas discharge load driven thereby, and (ii) an oscillation control means operable to deliver to the semiconductor switching means a oscillation control signal to cause the resonant oscillator means to oscillate with a frequency which is maintained in proportion to a modulated amplitude of the variable DC voltage, wherein, the pulsating current, when drawn from the DC terminals, is causing the unidirectional devices to exibit the switching action, thus causing the resonant boosting means to store and release energy during ON-time and OFF-time periods being proportional to a time period of a half-cycle associated with the frequency of oscillation of the resonant oscillator means; the boosting inductance means and the boosting capacitance means are operable to resonantly interact, and have a resonant frequency near or equal to the frequency of oscillation of the resonant oscillator means, and the resonant interaction is naturally and automatically synchronized with the oscillation of the resonant oscillator means; each of the alternately conducting transistors having a duty cycle associated with the conduction and said duty cycle is automatically modulated in proportion to the modulated amplitude of the variable DC voltage; the frequency of oscillation of the resonant oscillator means is considerably faster than a half-cycle frequency of the alternating voltage source;

whereby, an instantaneous magnitude of a current drawn from the alternating voltage source is substantially proportional to an instantaneous magnitude of the voltage of the alternating voltage source.

4. Device according to claims 1, 2 or 3, wherein the rectifier means can be either in the form of a full-wave rectifier bridge circuit, or a doubler circuit.

5. Device according to claims 1, 2 or 3, wherein the boosting inductance means can be either: (i) in the form of a simple inductor, (ii) in the form of a sectored common mode or a differential inductor, or (iii) in the form of two independent inductors.

6. Device according to claims 1, 2 or 3, wherein the boosting capacitance means comprises one or more capacitors connected in parallel with selected one or more unidirectional devices of the rectifier means.

7. Device according to claims 1, 2 or 3, wherein the resonant oscillator means having one or more of the gas discharge lamps is effectively connected in parallel with the capacitor either in a non-isolated or an isolated configuration, and an isolation transformer and the inductor can be integrated into one magnetic structure.

8. Electronic device operating directly from an alternating voltage source, having a rectifier integrated with a resonant boosting means operable to store and release energy in a periodical manner, and said device comprising:

a high frequency oscillator provided with switching means having a switching frequency and a switching duty cycle, said oscillator being equipped with a load circuit adapted to have a gas discharge load energized thereby, and the device being characterized by the fact, that the high frequency oscillator draws a pulsating current from the rectifier output in a periodical manner, causing a switching action of the rectifier, and causing the resonant boosting means to: (i) store and release the energy in a time period proportional to a time of a half-cycle of the switching frequency, and (ii) operate to develop at the rectifier output a variable DC voltage having absolute peak magnitude higher then absolute peak magnitude of a rectified voltage of the alternating voltage source;

wherein, the switching frequency and switching duty cycle being proportional to a modulated amplitude of the variable DC voltage, and the high frequency oscillator is naturally and automatically synchronized with the resonant boosting means, in such a way, that the switching action, as well as the periodical manner of energy storage and release, being determined by the switching frequency and the switching duty cycle of the switching means;

whereby, an instantaneous magnitude of a current drawn from the alternating voltage energy source is substantially proportional to an instantaneous magnitude of the voltage of the alternating voltage source.

9. An electronic device for powering a gas discharge load from a low frequency power line source wherein the device draws a current proportional to a voltage of the power line, the device comprising:

a resonant oscillator circuit having a switching transistor and adapted to energize the gas discharge load;

a power line voltage rectifier; and a resonant boosting circuit integrated into the power line voltage rectifier to perform boost switching and rectifying functions developed by and synchronized with a pulsating current drawn from the rectifier by the resonant oscillator circuit.

10. An inverter device for a high power factor current supply to a load, the device comprising:

rectifier means receiving an input voltage from an AC power source and providing at an output a pulsating DC voltage source having voltage of absolute peak magnitude higher than absolute peak magnitude of the rectified input voltage;

unidirectional device means coupled to the pulsating DC voltage source;

energy storage means receiving energy from the pulsating DC voltage source via the unidirectional device and providing at DC terminals a relatively constant DC voltage; and inverter circuit means connected in parallel with the energy storage means and comprising:

(i) semiconductor switching means receiving the constant DC voltage and operable in a periodical ON and OFF manner; and (ii) resonant oscillator means coupled to the semiconductor switching means and providing a high frequency signal to the load.

* * * * *

US005434480C1

(12) EX PARTE REEXAMINATION CERTIFICATE (9906th)

United States Patent

Bobel

(10) Number: US 5,434,480 C1

(45) Certificate Issued: Oct. 25, 2013

(54) ELECTRONIC DEVICE FOR POWERING A GAS DISCHARGE ROAD FROM A LOW FREQUENCY SOURCE

(76) Inventor: Andrzej A. Bobel, Des Plaines, IL (US)

Reexamination Request:
No. 90/012,613, Sep. 14, 2012

Reexamination Certificate for:

| | |
|---|---|
| Patent No.: | **5,434,480** |
| Issued: | **Jul. 18, 1995** |
| Appl. No.: | **08/134,976** |
| Filed: | **Oct. 12, 1993** |

(51) Int. Cl.
*H05B 37/02* (2006.01)

(52) U.S. Cl.
USPC .... 315/224; 315/209 R; 315/287; 315/200 R; 315/DIG. 2

(58) Field of Classification Search
None
See application file for complete search history.

(56) References Cited

To view the complete listing of prior art documents cited during the proceeding for Reexamination Control Number 90/012,613, please refer to the USPTO's public Patent Application Information Retrieval (PAIR) system under the Display References tab.

*Primary Examiner* — My Trang Nu Ton

(57) ABSTRACT

An electronic device for powering a gas discharge load (FL1) from a low frequency alternating voltage source (AVS). This device is drawing a current proportional to a voltage of the source (AVS) and is constituted by a resonant boosting circuit integrated into a power line voltage rectifier (BI,BRB) which performs boost switching and rectifying functions developed by and synchronized with a pulsating current drawn from the rectifier by a resonant oscillator circuit (RO1) equipped with a switching transistors (Q1,Q2) and adapted to energize the gas discharge load (FL1).

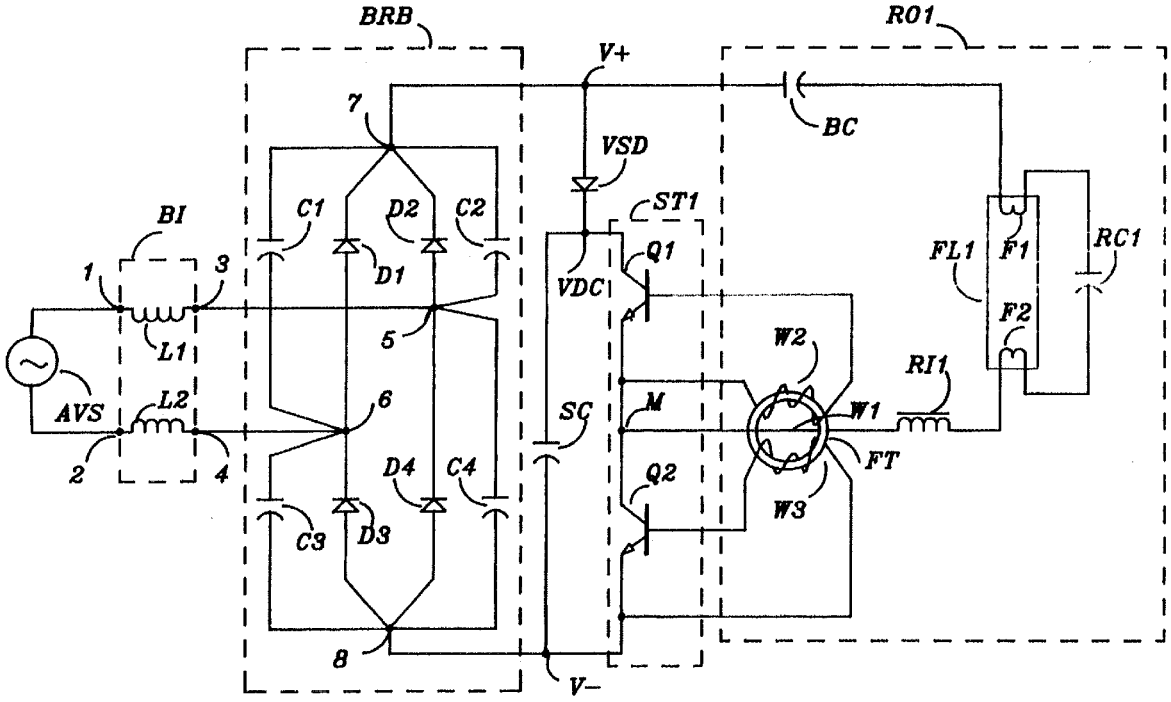

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claim 9 is confirmed.

Claims 1-8 and 10 were not reexamined.

* * * * *